US007201598B2

(12) United States Patent
Griffin

(10) Patent No.: US 7,201,598 B2
(45) Date of Patent: Apr. 10, 2007

(54) RF CONNECTOR/CABLE RELEASE MECHANISM

(75) Inventor: Joseph Dewey Griffin, Lake Oswego, OR (US)

(73) Assignee: Alcatel USA Sourcing, L.P., Plano, TX (US)

( * ) Notice: Subject to any disclaimer, the term of this patent is extended or adjusted under 35 U.S.C. 154(b) by 0 days.

(21) Appl. No.: 11/411,409

(22) Filed: Apr. 25, 2006

(65) Prior Publication Data

US 2006/0194468 A1 Aug. 31, 2006

Related U.S. Application Data

(63) Continuation of application No. 10/856,712, filed on May 28, 2004, now Pat. No. 7,066,759.

(60) Provisional application No. 60/475,219, filed on May 30, 2003.

(51) Int. Cl.
*H01R 13/627* (2006.01)

(52) U.S. Cl. ..... 439/352

(58) Field of Classification Search ..... 439/258, 439/259, 352, 447, 448
See application file for complete search history.

(56) References Cited

U.S. PATENT DOCUMENTS

| | | | | |
|---|---|---|---|---|
| 3,953,098 | A * | 4/1976 | Avery et al. | 439/258 |
| 4,176,899 | A * | 12/1979 | Betts | 439/155 |
| 5,620,335 | A * | 4/1997 | Siemon | 439/491 |
| 6,710,254 | B2 * | 3/2004 | Yueh | 174/135 |
| 2003/0082942 | A1 * | 5/2003 | Wlos | 439/348 |

FOREIGN PATENT DOCUMENTS

| | | | |
|---|---|---|---|
| DE | 4439852 | A1 * | 5/1996 |
| EP | 0467631 | * | 1/1992 |

* cited by examiner

*Primary Examiner*—Khiem Nguyen
(74) *Attorney, Agent, or Firm*—Van Pelt, Yi, & James LLP

(57) ABSTRACT

An actuating device for a connector having a push-pull coupling mechanism is disclosed. The device comprises a release pull integrated with the connector and configured to operably engage the push-pull coupling mechanism, and a grip, coupled to the release pull and remote from the push-pull coupling mechanism, to which force may be applied to cause the release pull to actuate the push-pull coupling mechanism.

9 Claims, 2 Drawing Sheets

RF CONNECTOR/CABLE RELEASE MECHANISM

CROSS REFERENCE TO RELATED APPLICATIONS

This application is a continuation of U.S. patent application No. 10/856,712 entitled RF CONNECTOR/CABLE RELEASE MECHANISM filed May 28, 2004 now U.S. Pat. No. 7,066,759 which is incorporated herein by reference for all purposes, which claims priority to U.S. Provisional Application No. 60/475,219, entitled RF CONNECTOR/CABLE RELEASE MECHANISM filed May 30, 2003, which is incorporated herein by reference for all purposes.

FIELD OF THE INVENTION

The present invention relates generally to cable connectors. More specifically, an RF connector/cable release mechanism is disclosed.

BACKGROUND OF THE INVENTION

One type of radio frequency (RF) connector in widespread use employs a push-pull coupling for insertion and removal of the associated RF cable. Such couplings may be used, for example, in telecommunications environments, such as to provide a plug for connecting an RF coaxial cable to a jack associated with a printed circuit board or other component. One such cable is the Series 1.0/2.3 RF connector used in many computer network environments.

An RF or other cable in which a push-pull coupling is used typically is connected by mating a plug assembly attached to the end of the cable to the jack to which the cable is to be connected by sliding the plug over the jack (or into the jack, as applicable) until the plug assembly is seated over (or in) the jack. In one typical configuration, the plug assembly comprises a body having a barrel portion into which the jack is received; a cam assembly inside the barrel portion of the plug body comprising one or more spring loaded cams which extend into a detent in the jack when the jack is inserted fully into the plug assembly, thereby locking the plug assembly onto to the jack such that one may pull on the associated cable with a degree of force and not decouple the cable and associated plug assembly from the jack; and a spring loaded movable collar on the outside of the barrel portion, configured to slide along the barrel in response to external force, typically in the direction away from the end of the cable to which the plug assembly is attached, and connected in relation to the cam assembly such that the cable may be disconnected by sliding the spring loaded movable collar on the outside of the plug body to a position which causes the one or more cams on the interior of the plug body to be retracted (such as by spring force), thereby making it possible to decouple the cable plug assembly from the jack by pulling on the cable and/or plug assembly with moderate force. The movable collar is sometimes referred to herein as the "release ring".

A problem arises when a large number of cables having push-pull coupling type release mechanisms must be connected in very close proximity to one another, such as in high density computer network applications, for example, to connect a large number of signal lines to a high density network switch. One difficulty that can arise in such contexts is that it may not always be possible for a user to grasp the movable cylinder on the outside of the plug body and manipulate it as necessary to disengage the one or more cams from the corresponding detent(s) on the jack, as would be required to disconnect the cable. If the plug assemblies for adjacent cables are too close to the cable to be removed, there may not be enough space to grab hold of the movable cylinder portion of the plug assembly for the cable to be removed.

Special tools have been provided to assist in the removal of cables connected via a push-pull coupling where it may not be possible to grasp the release mechanism with one's fingers, but providing such a tool is not always a convenient or practical solution, as a tool may be lost or unavailable when needed for some other reason. Also, a sufficient number of tools may not be available if it were necessary to remove multiple cables in the same work area at about the same time. In addition, the time required to locate the tool, place it into position to release a cable, release the cable, and then return the tool to its place make using such a tool less efficient than providing a release mechanism integral to each cable/plug assembly that does not suffer from the disadvantages described above. However, in order to be economically viable, such an integral release mechanism integral to each cable/plug assembly cannot cost too much per unit.

Therefore, there is a need for a reasonably low cost RF connector release mechanism suitable for use where a number of RF cables may need to be connected in close proximity to one another.

BRIEF DESCRIPTION OF THE DRAWINGS

Various embodiments of the invention are disclosed in the following detailed description and the accompanying drawings.

DETAILED DESCRIPTION

The invention can be implemented in numerous ways, including as a process, an apparatus, a system, a composition of matter, a computer readable medium such as a computer readable storage medium or a computer network wherein program instructions are sent over optical or electronic communication links. In this specification, these implementations, or any other form that the invention may take, may be referred to as techniques. In general, the order of the steps of disclosed processes may be altered within the scope of the invention.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

An RF connector/cable release mechanism is disclosed. In one embodiment, the release mechanism comprises an inserter/extractor device that fits over and becomes an integral part of the plug of an RF connector/cable having a push-pull coupling mechanism and allows the release ring to be engaged and operated by grasping the inserter/extractor device at a point remote from the point where the RF cable plug is mated to the jack to which the cable has been connected.

Figure 1A:
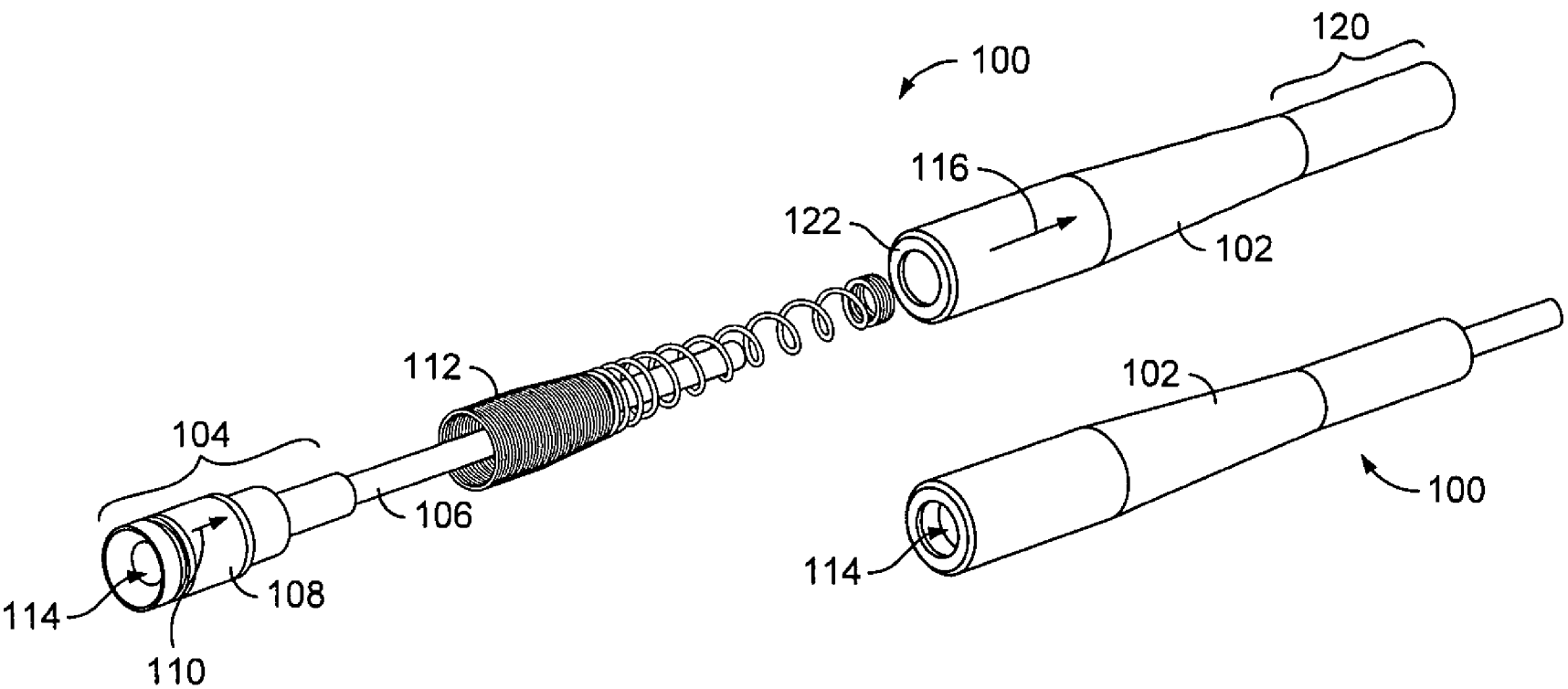
FIG. 1A shows in perspective view an exploded version (upper left) and an assembled version (lower right) of an RF connector/cable release mechanism used in one embodiment.

FIG. 1A shows in perspective view an exploded version (upper left) and an assembled version (lower right) of an RF connector/cable release mechanism used in one embodiment. The RF connector/cable release mechanism 100 comprises an RF cable inserter/extractor 102 positioned over a push-pull coupling type RF plug 104 connected to an RF cable 106. The plug 104 comprises a release ring 108 which when slid along the body of plug 104 in the direction of arrow 110 causes one or more cams (not shown) internal to the plug 104 to be retracted from the detent(s) in the jack to which the plug has been mated, thereby allowing the cable 106 and plug 104 to be pull away from the jack. The inserter/extractor 102 is configured in one embodiment to engage the release ring 108 but not the cable 106, such that when the inserter/extractor 102 is pulled in the direction of arrow 110 along the longitudinal axis of cable 106 while the cable 106 is held steady, the inserter/extractor 102 moves the release ring 108 relative to the cable 106 in the direction of arrow 110, thereby activating the release mechanism of push-pull type plug 104 (e.g., by causing one or more spring loaded cams internal to plug 104 to retract and by so doing withdraw from detents in a jack to which the plug 104 had previously been mated, causing the plug 104 to become disengaged from the jack such that the plug 104 and cable 106 may be removed from the jack. In the embodiment shown, the inserter/extractor 102 comprises a release pull 122 configured to operably engage the push-pull release mechanism of plug 104 when the inserter/extractor 102 is grasped and pulled at grip end 120 while cable 106 is held in place or pushed forward (i.e., in the direction opposite to that in which the grip end 120 is being pulled). Grip end 120 is configured such that it moves freely relative to cable 106. In the embodiment shown, a spring 112 spaces the grip end 120 from the cable 106, ensuring such freedom of movement.

In one embodiment, spring 112 is located within the inserter/extractor 102 and around the plug 104 and a portion of the cable 106. The spring 112 acts as a spacer ensuring that the inserter/extractor 102 may be moved along the longitudinal axis of the cable 106 when grasped, such as by preventing the inserter/extractor 102 from collapsing onto or otherwise engaging the cable 106. The spring 112 is configured such that it moves along the longitudinal axis of cable 106 as the 102 is moved and is configured to ensure that it does not interfere with the movement of the release ring 108 along the longitudinal axis of cable 106 (e.g., in the direction of arrow 110) when the inserter/extractor 102 is moved. The spring 112 provides strain relief, relieving the strain at the point where the cable 106 meets the plug 104, for example, during bending or manipulation of the cable 106 and/or inserter/extractor 102.

In one embodiment, the inserter/extractor 102 comprises a flexible polymer material. In one embodiment, the inserter/extractor 102 comprises a shrink fit polymer that has been shrunk around the spring 112, using the spring 112 as a spacer between the inserter/extractor 102 and the cable 106, in such a way that the inserter/extractor 102 wraps around and engages the release ring 108 without blocking the opening 114 of the plug 104, whereby a jack may be received into the opening 114 and the release ring 108 may be engaged and operated to release the plug 104 from such a jack by grasping the inserter/extractor 102 and moving it in the direction of arrow 116 relative to the cable 106. In one embodiment, the inserter/extractor 102 comprises an injection molded flexible polymer. In other embodiments, materials other than polymer materials and less flexible or rigid materials may be used.

Figure 1B:
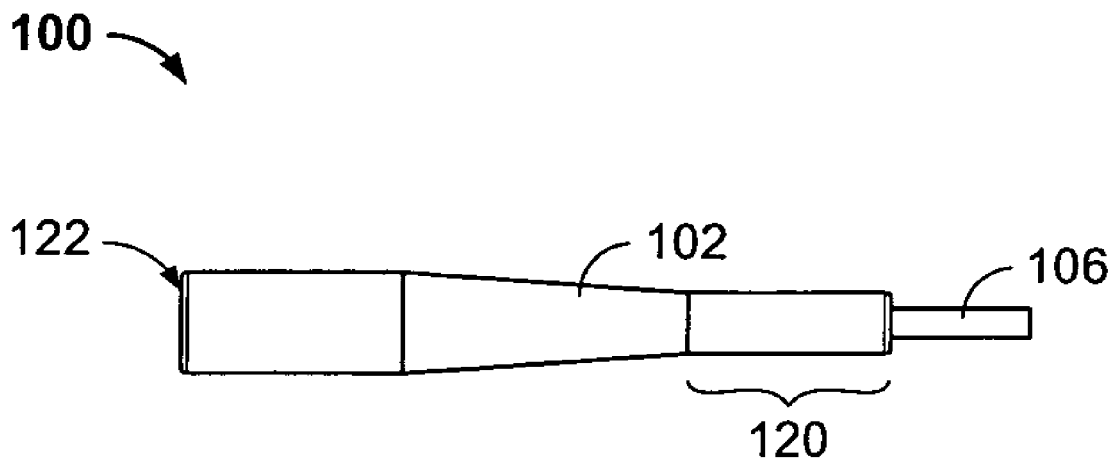
FIG. 1B shows a side view of an assembled RF connector/cable release mechanism 100.
Figure 1C:
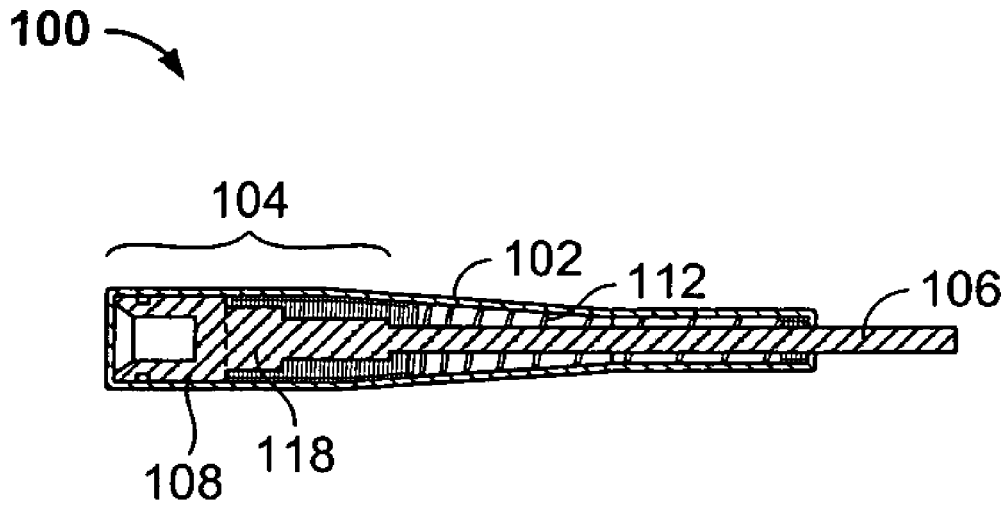
FIG. 1C shows a size cross-sectional view of the RF connector/cable release mechanism 100 shown in FIGS. 1A and 1B.

FIG. 1B shows a side view of an assembled RF connector/cable release FIG. 1C shows a size cross-sectional view of the RF connector/cable release mechanism 100 shown in FIGS. 1A and 1B mechanism 100. In one embodiment, the inserter/extractor 102 is spaced from the cable 106 and a stationary shaft portion 118 of plug 104 by spring 112. In one embodiment, inserter/extractor 102 fits snugly around and engages spring 112, which is movable along cable 106 and stationary shaft portion 118. Inserter/extractor 102 and spring 112 may be moved longitudinally along shaft 118 and cable 106 in the direction to the right as shown in FIG. 1C to engage and slide release ring 108 relative to the shaft 118 and cable 106 in the direction of arrow 110 of FIG. 1A, thereby causing the plug 104 to become disengaged from a jack to which it has previously been mated.

As can be seen from FIGS. 1A–1C, providing the inserter/extractor 102 enables the release mechanism of the plug 104 to be engaged and operated by grasping the inserter/extractor 102 at a grip end 120 remote from the plug 104, which permits the release mechanism to be actuated from a point remote from the plug 104 by applying force to the grip end 120 causing the release pull 122 at the opposite end of the inserter/extractor 102 to engage and actuate the push-pull release mechanism of the plug 104.

While in the embodiments shown in FIGS. 1A–1C the release pull 122 and the grip end 120 are integral parts of an inserter/extractor 102 comprising a unitary tubular body, in other embodiments the release pull and grip may be coupled in other ways that allow the release pull to operably engage the push-pull mechanism when force is applied to the grip located remotely from the push-pull mechanism.

In a context in which many cables have been connected very near each other, providing the inserter/extractor 102 would enable the release mechanism for an individual cable to be actuated at a point at which it would be easier to separate the cable to be removed from adjacent cables and remove the cable of interest without disturbing or being obstructed by such adjacent cables. A similar advantage may be realized with respect to connecting the cable, as one can slide the plug onto (or into, as applicable) the jack by grasping the inserter/extractor 102 at a point remote from the plug.

The above-described RF connector/cable release mechanism permits RF module designs that provide maximum utilization of front panel space. The pitch between ports is now determined by the connector size, not the clearance required for accessibility. In one embodiment, use of flexible materials allows densely packed cables to be moved aside, allowing access to any one cable requiring service. In one embodiment, the use of a rigid internal structure, such as spring 112, allows the inserter/extractor 102 to be pushed upon for insertion and pulled upon for release. There are no tools to maintain or risk losing, as the inserter/extractor 102 is integrated with the cable and plug assembly. The designs described above allow for inexpensive production through the use of inexpensive materials such as plastic and wire. The design provides strain relief for the cable, thereby helping to prevent loss of signal due to cable failure.

By using inserter/extractors of differing colors, coding of individual cables is possible. This would help to differentiate between Transmit and Receive cables, for example, in a computer network switch context, an advantage when servicing the system. In one embodiment, electrically non-conductive materials are used to make the inserter/extractor 102 to help control electrostatic discharge stresses to the system during servicing.

In one embodiment, an integrated light transmission device can be incorporated into the RF connector/cable release mechanism, such as to transmit port (or other connection) status, to the view of the user. In one embodiment, a visible indication of port (or other connection) status is generated by a light emitting diode (LED) or other source of light and displayed in a manner intended to be visible to one viewing the front panel of the module or other device to which the cable has been connected. Currently, densely packed cables would cover and thereby block such LEDs located on the module front panel, obscuring the status to the user. By integrating a light path into the RF connector/cable release mechanism described herein, such an indicator light signal could be transmitted through the release mechanism and made visible to a user at the end of the inserter/extractor opposite the plug assembly.

While in the embodiments described in detail above the connector/cable release mechanism has been described as being used in connection with a radio frequency (RF) connector/cable, the same structures and techniques may be used advantageously in connection with push-pull type connectors used in other contexts as well.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. An actuating device for a connector having a push-pull coupling mechanism, comprising:

a release pull integrated with the connector and configured to operably engage an axially movable release actuator of the push-pull coupling mechanism; and a grip, coupled to the release pull and remote from the push-pull coupling mechanism, to which force may be applied to cause the release pull to actuate the push-pull coupling mechanism by retracting the axially movable release actuator.

2. The actuating device of claim 1 wherein the actuating device comprises a tubular body that encases at least a portion of the connector and a cable connected thereto; a first end of the tubular body comprises said release pull; and a second end of the tubular body, located opposite the first end and remote longitudinally along the cable from the connector, comprises said grip.

3. The actuating device of claim 2 wherein the tubular body is flexibly resilient.

4. The actuating device of claim 2 wherein the tubular body comprises a flexible polymer.

5. The actuating device of claim 2 wherein the tubular body comprises an injection molded flexible polymer.

6. The actuating device of claim 1 wherein the release pull is coupled to the grip by a coupling structure capable of transmitting compressive force such that the connector may be mated to a jack by grasping the actuating device at the grip and sliding the connector into position to mate with the jack.

7. The actuating device of claim 1 wherein a visible portion of the actuating device is coded with a selected one of a plurality of colors each of which is associated with a corresponding type of cable.

8. The actuating device of claim 1 further comprising a light transmission device configured to transmit to a point at or near the grip light emitted by an indicator light associated with a jack to which the connector has been mated.

9. The actuating device of claim 1 wherein the release pull and grip comprise electrically non-conductive material such that electrostatic discharge stresses are minimized.

* * * * *